US006170720B1

(12) United States Patent
Gnepper et al.

(10) Patent No.: US 6,170,720 B1
(45) Date of Patent: Jan. 9, 2001

(54) DISPENSING CLOSURE WITH SPOUT VENT

(75) Inventors: Maurice R. Gnepper, Toledo; Thomas A. Kozlowski, Perrysburg, both of OH (US)

(73) Assignee: Owens-Illinois Closure Inc., Toledo, OH (US)

( * ) Notice: Under 35 U.S.C. 154(b), the term of this patent shall be extended for 0 days.

(21) Appl. No.: 09/552,722

(22) Filed: Apr. 19, 2000

(51) Int. Cl.[7] ..... B67D 3/00
(52) U.S. Cl. ..... 222/481.5; 222/521
(58) Field of Search ..... 222/212, 481.5, 222/519, 520, 521, 525

(56) References Cited

U.S. PATENT DOCUMENTS

| | | | | |
|---|---|---|---|---|
| 3,326,426 | | 6/1967 | Porter et al. . | |
| 3,489,323 | * | 1/1970 | Hug | 222/525 |
| 3,520,453 | | 7/1970 | Stull . | |
| 3,587,937 | | 6/1971 | Childs . | |
| 3,598,285 | | 8/1971 | Stull . | |
| 3,717,289 | | 2/1973 | Laurizio . | |
| 3,844,455 | | 10/1974 | Stull . | |
| 3,848,779 | | 11/1974 | Stull . | |
| 4,314,658 | | 2/1982 | Laauwe . | |
| 4,377,248 | | 3/1983 | Stull . | |
| 4,424,918 | | 1/1984 | Stull . | |
| 4,438,870 | | 3/1984 | Stull . | |
| 4,474,314 | | 10/1984 | Roggenburg, Jr. . | |
| 4,477,002 | | 10/1984 | Stull . | |
| 4,546,893 | | 10/1985 | Stull . | |
| 4,570,825 | | 2/1986 | Stull . | |
| 4,625,899 | | 12/1986 | Stull . | |
| 4,635,823 | | 1/1987 | Stull . | |
| 4,646,945 | | 3/1987 | Steiner et al. . | |
| 4,646,947 | | 3/1987 | Stull . | |
| 4,646,949 | | 3/1987 | Stull . | |
| 4,653,676 | | 3/1987 | Stull . | |
| 4,747,518 | | 5/1988 | Laauwe . | |
| 4,754,899 | | 7/1988 | Stull . | |
| 4,773,572 | * | 9/1988 | Stull | 222/575 |
| 4,826,055 | | 5/1989 | Stull . | |
| 4,842,169 | | 6/1989 | Stull . | |
| 4,865,224 | | 9/1989 | Streck . | |
| 4,878,774 | | 11/1989 | Karasin et al. . | |
| 5,044,530 | | 9/1991 | Stull . | |
| 5,046,646 | | 9/1991 | Stull . | |
| 5,090,598 | | 2/1992 | Stull . | |
| 5,121,859 | | 6/1992 | Stull . | |
| 5,147,076 | | 9/1992 | Zanotelli . | |
| 5,181,632 | | 1/1993 | Latter . | |
| 5,358,146 | | 10/1994 | Stull . | |
| 5,358,152 | | 10/1994 | Banks . | |
| 5,377,873 | | 1/1995 | Minnette . | |
| 5,472,120 | * | 12/1995 | Stebick et al. | 222/525 |
| 5,605,257 | | 2/1997 | Beard . | |
| 5,713,493 | | 2/1998 | Garibald . | |
| 5,988,448 | * | 11/1999 | Foth | 222/525 |

* cited by examiner

*Primary Examiner*—Kevin Shaver
*Assistant Examiner*—Thach H Bui

(57) ABSTRACT

A closure for a fluid product dispensing package that includes a tubular body for securement to a container, and having a central flow passage and a cylindrical peg axially spaced from the flow passage. A spout has a dispensing orifice, and is mounted on the base for movement between an open position in which the dispensing orifice is axially spaced from the peg to permit product flow through the passage around the peg and through the orifice, and a closed position in which the dispensing orifice closely surrounds the peg to block product flow. The dispensing orifice is circular, and has three angularly spaced recesses extending radially outwardly from and arcuately around the opening forming air vents with the peg in the closed position of the spout.

8 Claims, 2 Drawing Sheets

DISPENSING CLOSURE WITH SPOUT VENT

The present invention is directed to dispensing closures and packages for fluid products such as mustard, and more particularly to a closure and package that forms an air vent in the closed position of the closure to prevent paneling at the package container.

BACKGROUND AND SUMMARY OF THE INVENTION

Dispensing closures for fluid products such as mustard conventionally include a base for securement to a flexible resilient container, and a dispensing spout carried for limited movement on the base. The base has a central flow tube, and a peg or plug spaced from the flow tube. The dispensing spout has an opening or orifice that closely surrounds the peg on the base in the closed position of the spout. The dispensing spout is typically coupled to the base by a spiral cam or thread for movement between the closed position in which the dispensing orifice closely surrounds the peg, and an open position in which the dispensing orifice is axially spaced from the peg to allow product flow through the tube, around the peg and through the orifice in response to squeezing of the flexible resilient container body.

A problem with dispensing packages of this type is that, if the dispensing spout is closed while the container is squeezed by a user, or before the container body has resiliently returned to its nominal geometry after being released by the user, the dispensing spout orifice cooperates with the peg to block entry of air into the package. The container body will thus remain distorted under a partial vacuum within the container, termed container sidewall paneling in the art. This condition is deemed undesirable from an appearance standpoint. It has been proposed to provide a flat on the cylindrical surface of the peg so as to form a chordal air vent through the spout dispensing opening in the closed position of the spout. However, such a structure requires substantial modification of the tooling for making the base. Furthermore, in mustard dispensing applications, vinegar that separates from the mustard can leak through an air vent formed by a flat on the base peg. It is therefore a general object of the present invention to provide a liquid dispensing package, and a closure for such a package, in which one or more air vents are provided between the dispensing spout orifice and the base peg in the closed position of the spout with minimum modification of existing tooling, and that can be controlled in size and shape so as to permit free passage of air while limiting or blocking passage of product from the container, such as vinegar separated from mustard during storage.

A dispensing package for fluid products such as mustard, in accordance with a presently preferred embodiment of the invention, comprises a container having a flexible resilient body and a cylindrical neck with external means for securement of a closure, and a closure having a base and a spout movably mounted on the base. The closure base has a skirt with internal means for securement to the container neck, a hollow dispensing tube and a cylindrical peg spaced from an end of the tube. The spout has a dispensing orifice and is mounted on the base for movement between an open position in which the orifice is axially spaced from the peg and squeezing of the flexible resilient container body causes product to flow through the tube around the peg and through the dispensing orifice, and a closed position in which the orifice surrounds the peg to block such product flow. The spout dispensing orifice is circular, and has at least one recess extending radially outwardly from and arcuately around the orifice forming a vent in cooperation with the peg for admission of air into the container in the closed position of the spout.

A closure for a fluid product dispensing package in accordance with another aspect of the invention includes a tubular body for securement to a container, and having a central flow passage and a cylindrical peg axially spaced from the flow passage. A spout has a dispensing orifice, and is mounted on the tubular body for movement between an open position in which the dispensing orifice is axially spaced from the peg to permit product flow through the passage around the peg and through the orifice, and a closed position in which the dispensing orifice closely surrounds the peg to block product flow. The dispensing orifice is circular, and has at least one recess extending radially outwardly from and arcuately around the opening forming an air vent in cooperation with the peg in the closed position of the spout. In the preferred embodiment of the invention, there are three recesses uniformly angularly spaced around the dispensing opening.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 2:
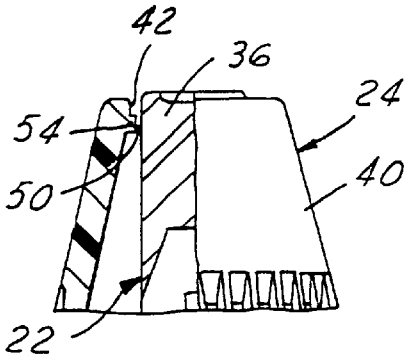
FIG. 2 is a fragmentary sectional view of the portion of FIG. 1 within the circle 2.
Figure 3:
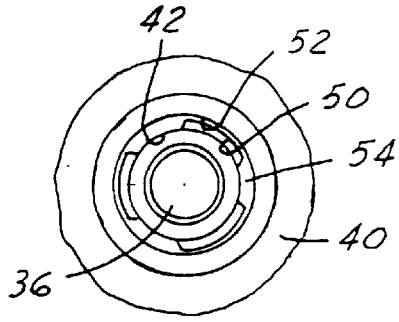
FIG. 3 is a fragmentary top plan view of the package illustrated in FIG. 1.
Figure 1:
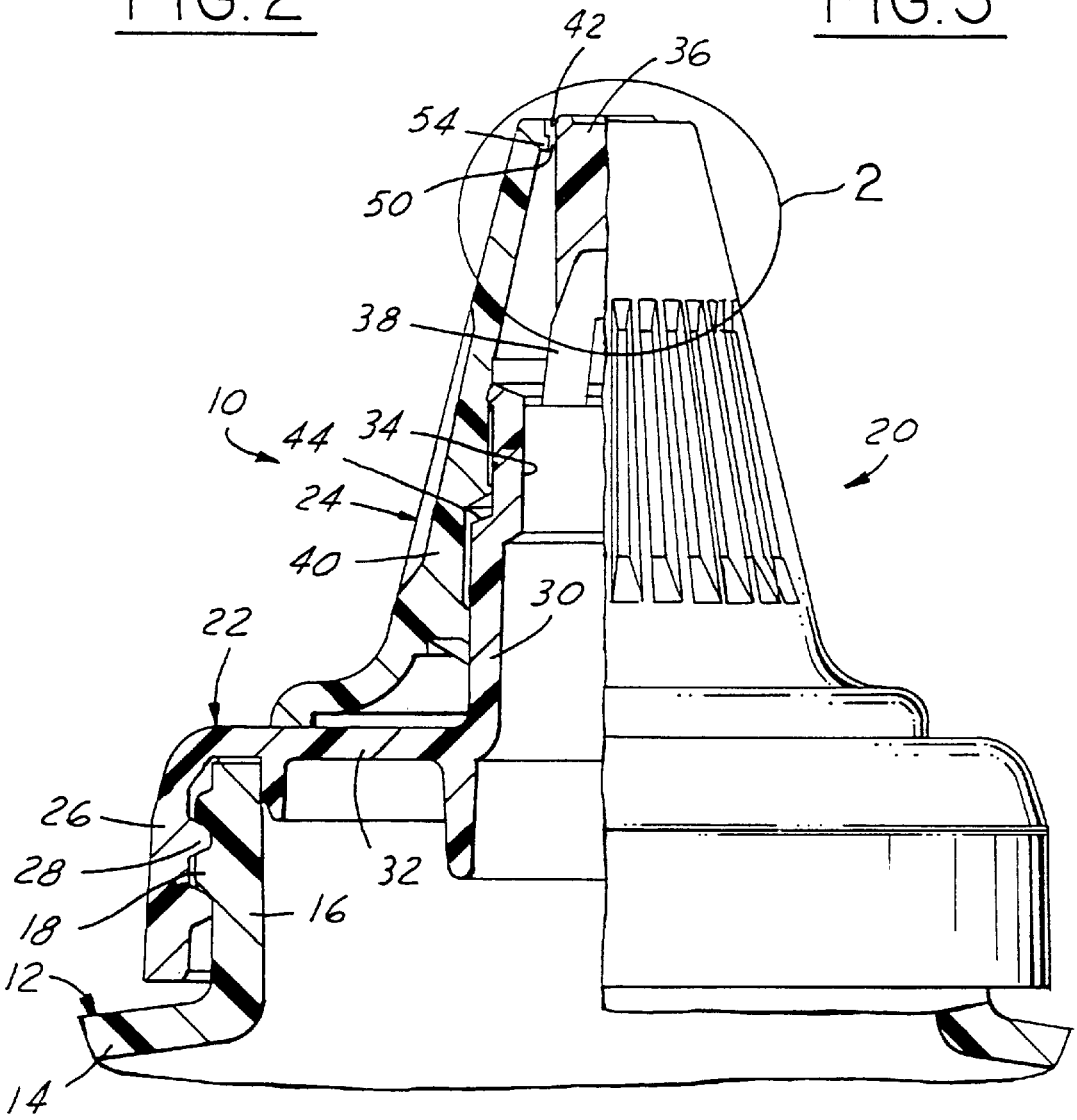
FIG. 1 is a fragmentary partially sectioned elevational view of a fluid dispensing package in accordance with a presently preferred embodiment of the invention.
Figure 6:
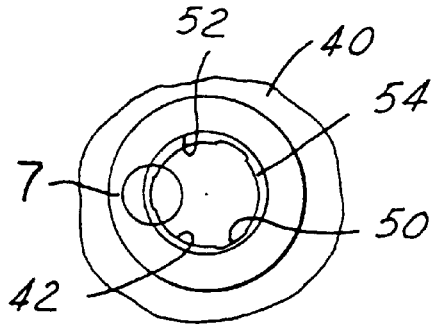
FIG. 6 is a fragmentary top plan view of the dispensing spout illustrated in FIG. 4.
Figure 7:
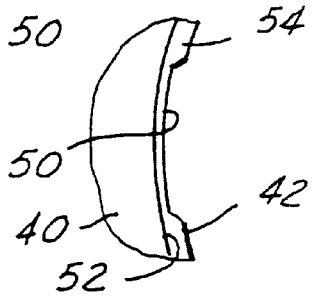
FIG. 7 is a fragmentary view on an enlarged scale of the portion of FIG. 6 within the circle 7.

FIGS. 1–3 illustrate a package 10 in accordance with a presently preferred embodiment of the invention as comprising a container 12 of blow molded plastic construction, for example. Container 12 has a flexible resilient body 14 that terminates in a cylindrical neck or finish 16. Neck 16 has external means for securing a closure to container 12, such as an annular bead or one or more external helical threads 18. Container body 14 is preferably of a resilient plastic construction that will return to its original geometry after being squeezed and released by a user.

A closure assembly 20 is secured to container neck 16. Closure assembly 20 includes a base 22 and a dispensing spout 24 movably mounted on base 22. Base 22 has a cylindrical skirt 26 with internal means, such as an internal bead or thread 28, for securement over container heck 16. A central dispensing tube 30 extends from a base wall 32 of base 22, and has an internal fluid dispensing passage 34. A cylindrical sealing plug or peg 36 is mounted by angularly spaced legs 38 spaced from the axial end of tube 30. Dispensing spout 24 comprises a generally conical spout body 40 that terminates at its narrow end in a dispensing orifice 42 that closely surrounds peg 36 in the closed position of spout 24 illustrated in FIGS. 1–3. There is a spiral cam or thread 44 between spout 24 and tube 30 to provide for limited axial movement of spout 24 with respect to base 22 between the closed position illustrated in FIG. 1 in which product flow is blocked, and an open position in which orifice 42 is axially spaced from peg 36. In this open position, squeezing of container body 14 causes the liquid product contained therein to flow through tube passage 34, between legs 38 and around peg 36 through dispensing orifice 42. When the container is released, the resilient construction of the container body permits the container body to return to its nominal configuration. However, if spout 24 is closed over peg 36 while the container is still being squeezed by the user, or before the container body has had an opportunity to return fully to its nominal configuration, the partial vacuum within the container body will cause the container sidewall to remain in the partially squeezed and distorted condition, termed container sidewall paneling in the art. Closure base 22 and spout 24 may be of any suitable injection molded plastic construction.

Figure 5:
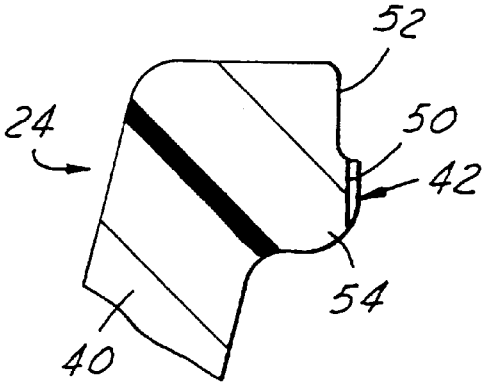
FIG. 5 is a fragmentary view on an enlarged scale of the portion of FIG. 4 within the circle 5.
Figure 4:
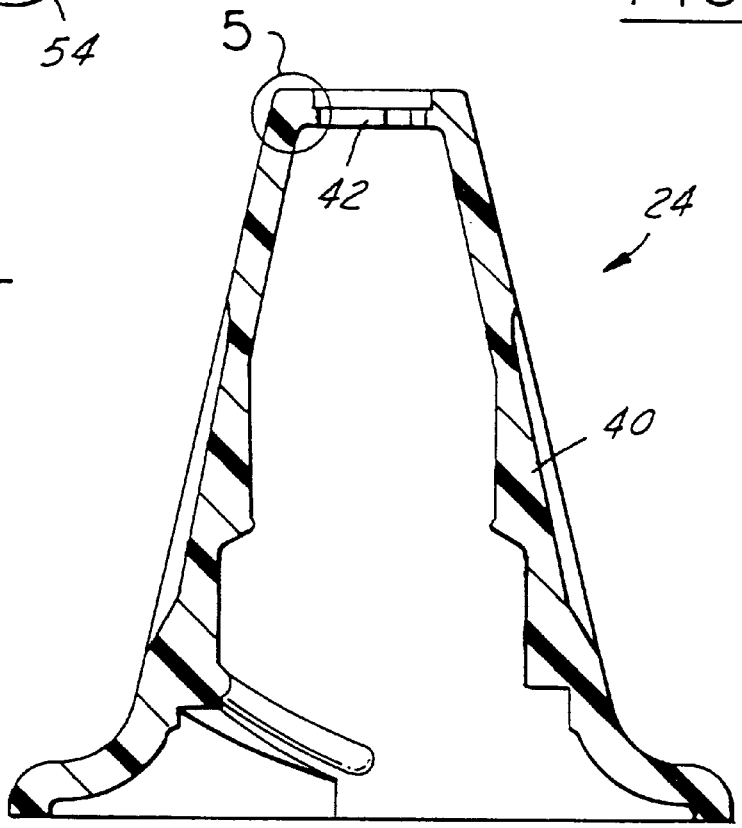
FIG. 4 is a diametrically sectioned elevational view of the dispensing spout in the package of FIGS. 1–3.

In order to vent the interior of package 10 and prevent sidewall paneling as described above, and in accordance with the present invention, spout dispensing opening or orifice 42 is provided with at least one arcuate recess 50 (FIGS. 1–7), and preferably a plurality of angularly spaced arcuate recesses 50. More specifically, and as best seen in FIGS. 4–5, dispensing orifice 42 is formed by a cylindrical interior wall 52, at the lower or interior edge of which a ledge 54 extends radially inwardly. Ledge 54 thus forms the inside diameter of orifice 42. The circular inner edge of ledge 54 is segmented by three angularly spaced recesses 50. Ledge 54 thus forms three angularly spaced arcuate lands for facing engagement with the outer cylindrical surface of peg 36, alternating with three angularly spaced recesses 50 around peg 36. The bottoms of recesses 50 are thus radially spaced from the opposing surface of peg 36, forming the air vents that characterize the present invention.

Thus, in the closed position of spout 24 over peg 36 illustrated in FIGS. 1–3, recesses 50 form three angularly spaced vents for passage of air into package 10 through closure 20. Recesses 50 preferably are sized to permit free flow of venting air, but to limit or prevent leakage of product from within the package even if the package container sidewall is squeezed. In a currently preferred embodiment of the invention in which peg 36 has a diameter of 0.185 inch (all dimensions are nominal and exemplary), orifice shoulder 54 has an inside diameter of 0.181 inch to ensure a tight interference fit between the dispensing orifice and the base peg. Recesses 50 have a radial dimension of 0.003 inch and a chordal dimension of 0.50 inch. The small radial dimension of recesses 50 (exaggerated in the drawings for purposes of illustration) prevents leakage of product even if the container body is squeezed by a user. In applications for dispensing mustard, the small orifice sizes also prevent leakage of vinegar that can separate from the mustard during storage.

There have thus been provided a dispensing closure and package that fully satisfy all of the objects and aims previously set forth. Air vents are provided to vent the interior of the package, and thereby prevent paneling of the package container sidewall, even if the package is closed before the container sidewall has had an opportunity to recover to its nominal geometry. Vents 50 can be provided with only minor modification of existing tooling for molding spout 24. The arcuate dimensions of recesses 50 can be readily controlled to prevent leakage or dispensing of product from within the container. The invention has been disclosed in conjunction with a presently preferred embodiment thereof, and several modifications and variations have been suggested. The invention is intended to embrace all such modifications and variations as fall within the spirit and broad scope of the appended claims.

What is claimed is:

1. A dispensing package for fluid products, which comprises:

a container having a flexible resilient body and a cylindrical neck with external means for securement of a closure, and a closure having a base and a spout movably mounted on said base, said base having a skirt with internal means for securement to said external means, a hollow dispensing tube and a cylindrical peg on an end of said dispensing tube, said spout having a dispensing orifice and being mounted on said base for movement between an open position in which said orifice is axially spaced from said peg and squeezing of said flexible resilient container body causes product within said container to flow through said hollow dispensing tube around said peg and through said orifice, and a closed position in which said orifice surrounds said peg to block product flow, said dispensing orifice being circular and having at least one recess extending radially outwardly from and arcuately around said orifice forming a vent with said peg for admission of air into said container in said closed position of said spout.

2. The package set forth in claim 1 comprising a plurality of said recesses angularly spaced from each other around said dispensing orifice of said spout.

3. The package set forth in claim 2 comprising three of said recesses uniformly spaced around said dispensing orifice.

4. The package set forth in claim 3 for dispensing mustard wherein each of said recesses has a radial dimension of about 0.003 inch and a chordal dimension of about 0.050 inch.

5. A closure for a fluid dispensing package, which comprises:

a tubular base for securement to a container, and having a central flow passage and a cylindrical peg axially spaced from said flow passage, and a spout having a dispensing orifice and being mounted on said base for movement between an open position in which said dispensing orifice is spaced axially from said peg to permit product flow through said passage around said peg and through said orifice, and a closed position in which said dispensing orifice closely surrounds said peg to block product flow, said dispensing orifice being circular, and having at least one recess extending radially outwardly from and arcuately around said opening forming an air vent with said peg in said closed position of said spout.

6. The closure set forth in claim 5 comprising a plurality of said recesses angularly spaced from each other around said dispensing orifice of said spout.

7. The closure set forth in claim 6 comprising three of said recesses uniformly spaced around said dispensing orifice.

8. The closure set forth in claim 7 wherein each of said recesses has a radial dimension of about 0.003 inch and a chordal dimension of about 0.050 inch.

* * * * *

UNITED STATES PATENT AND TRADEMARK OFFICE

CERTIFICATE OF CORRECTION

PATENT NO. : 6,170,720 B1
DATED : January 9, 2001
INVENTOR(S) : Maurice R. Gnepper and Thomas . Kozlowski It is certified that error appears in the above-identified patent and that said Letters Patent is hereby corrected as shown below:

Column 3,
Line 52, delete "0.050 inch" and insert -- 0.050 inch --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*